US005165513A

United States Patent [19]

Nakatani

[11] Patent Number: 5,165,513

[45] Date of Patent: Nov. 24, 1992

[54] CIRCULATING CIRCULAR ESCALATOR

[75] Inventor: Hiroshi Nakatani, Inazawa, Japan

[73] Assignee: Mitsubishi Denki Kabushiki Kaisha, Tokyo, Japan

[21] Appl. No.: 501,250

[22] Filed: Mar. 29, 1990

[30] Foreign Application Priority Data

Mar. 30, 1989 [JP] Japan ..... 1-79669
Dec. 20, 1989 [JP] Japan ..... 1-328369

[51] Int. Cl.[5] ..... B66B 21/00

[52] U.S. Cl. ..... 198/324; 198/328; 198/335

[58] Field of Search ..... 198/328, 335, 324, 325

[56] References Cited

U.S. PATENT DOCUMENTS

| | | | |
|---|---|---|---|
| 935,631 | 10/1909 | Adkins et al. | 198/328 |
| 967,710 | 8/1910 | Bennett | 198/328 |
| 4,411,352 | 10/1983 | Kettle | 198/328 |
| 4,662,502 | 5/1987 | Nakatani | 198/328 |
| 4,681,206 | 7/1987 | Sugita . | |
| 4,726,460 | 2/1988 | Otomo | 198/328 |
| 4,730,717 | 3/1988 | Sugita | 198/328 |
| 4,746,000 | 5/1988 | Nakatani et al. | 198/328 |
| 4,775,043 | 10/1988 | Tomidokoro | 198/328 |
| 4,809,840 | 5/1989 | Nakatani | 198/328 |

FOREIGN PATENT DOCUMENTS

| | | | |
|---|---|---|---|
| 3301397 | 7/1984 | Fed. Rep. of Germany | 198/328 |
| 1505971 | 4/1972 | Japan . | |
| 5035884 | 4/1975 | Japan . | |
| 58-140997 | 9/1983 | Japan . | |
| 8910890 | 11/1989 | Japan . | |

*Primary Examiner*—Joseph E. Valenza
*Attorney, Agent, or Firm*—Leydig, Voit & Mayer

[57] ABSTRACT

A circulating circular escalator has a vertically-oriented rotatable cylinder extending between upper and lower floors. An annular stairway having a plurality of steps is disposed about the rotatable cylinder. An annular cam member is disposed around the rotatable cylinder for camming and guiding the steps to move along the stairway, and a landing board extends over each of the upper and lower horizontal runs of the stairway. The stairway includes a lower horizontal run at a lower floor level, an upper horizontal run at an upper floor level, and ascending and descending sloped runs connected between the lower and upper runs. The sloped runs may be used for conveying passengers, or either one of the runs may be used as a return run. The inner sides of the steps are attached to the rotatable cylinder for rotation therewith, the steps each being independently vertically slidable relative to the rotatable cylinder. The steps are supported and guided by vertical guide rails on the rotatable cylinder and guide rollers on the steps for smooth translational movement. The load-bearing run may be made longer and therefore less steep than the return run. At least one intermediate horizontal run with a landing board may be disposed at an intermediate level between the upper and lower horizontal runs for serving an additional intermediate floor.

20 Claims, 7 Drawing Sheets

CIRCULATING CIRCULAR ESCALATOR

BACKGROUND OF THE INVENTION

This invention relates to a circulating circular escalator.

FIGS. 1 and 2 illustrates one example of a conventional circular circulating escalator disclosed in Japanese Patent Laid-Open No. 50-35884. In FIGS. 1 and 2, the circulating circular escalator comprises a stationary inner cylinder 1, a rotary outer cylinder 2 disposed in a coaxial relationship with respect to the stationary inner cylinder 1, a lower floor 3 disposed adjacent to the rotary outer cylinder 2, an upper floor 4, a lower landing way 5 formed in the rotary outer cylinder 2 in correspondence with the lower floor 3, an upper landing way 6 formed in the rotary outer cylinder 2 in correspondence with the upper floor 3 and a plurality of steps 7 radially arranged around an outer surface of the stationary inner cylinder 1 and vertically slidably engaged at an inner end with the stationary inner cylinder 1 to form a stairway around the stationary inner cylinder 1. A rail arrangement 8 secured to an inner surface of the rotary outer cylinder 2 for rotation therewith is disposed under the steps 7 to slidably support them. The rail arrangement 8 extends over a complete circumference within the rotary outer cylinder 2 and disposed under the steps 7 to slidably support them. The rail arrangement 8 slidably supports the steps 7 and has an ascending portion and a descending portion.

When the rotary outer cylinder 2 is rotated about its central axis, the lower and the upper landing ways 5 and 6 as well as the rail arrangement 8 are rotated. This causes the rail arrangement 8 on which the steps 7 are slidably engaged to cam the steps 7 to drive them up and down along axial lines parallel to the central axis of the stationary inner cylinder 1 between the lower floor 3 and the upper floor 4. Thus, a passenger, who rides on the steps 7 passing through the lower landing way 5 formed in the rotating outer cylinder 2, is vertically upwardly conveyed by the steps 7 as the camming rail arrangement 8 rotates and lift the steps 7. When the steps 7 on which the passenger is standing reach the level of the upper floor 4, the upper landing way 6 formed in the rotating outer cylinder 2 comes to the position corresponding to these particular steps 7, so that the passenger can step out from the steps 7 through the landing way 6 onto the upper floor 4.

With the above described conventional circulating circular escalator, the lower and the upper landing ways 5 and 6 defined in the rotary outer cylinder 2 are always circumferentially moving. Therefore, the passenger must pass through the landing way 5 or 6 which is traversely moving in front of him or her to step into the rotary outer cylinder 2 and onto the steps 7. This is dangerous.

SUMMARY OF THE INVENTION

Accordingly, the chief object of the present invention is to provide a circulating circular escalator free from the disadvantage of the above-discussed conventional circulating circular escalator.

Another object of the present invention is to provide a circulating circular escalator that is safe for the passengers.

Another object of the present invention is to provide a circulating circular escalator having a large capacity.

With the above objects in view, the circulating circular escalator of the present invention comprises a rotatable cylinder extending at least between an upper floor and a lower floor and rotatable about its substantially vertically-oriented central axis, drive means for rotating the rotatable cylinder about the central axis, a circular stairway disposed about the rotatable cylinder, circular cam means disposed around the rotatable cylinder for camming and guiding the steps to move along the stairway, and a landing board extending over each of the upper and lower horizontal runs of the stairway. The stairway comprises a lower horizontal run at a level of the lower floor, an upper horizontal run at a level of the upper floor, and a first and a second sloped run connected between the lower and upper horizontal runs. The stairway includes a plurality of steps each having an inner side attached to an outer circumference of the rotatable cylinder for rotation therewith, the steps each being independently slidable along the central axis of the rotatable cylinder for a lift corresponding to a distance between the upper and lower floors.

The cam means may comprise a lower horizontal cam surface corresponding to the lower horizontal run, an upper horizontal cam surface corresponding to the upper horizontal run, a first and a second sloped cam surface connected between the upper and lower horizontal cam surfaces. The first and the second sloped runs may comprise an ascending and a descending load-bearing runs for conveying passengers, or alternatively may comprise a load-bearing run for conveying passengers and the second sloped run comprises a return run having a slope steeper than that of the first sloped run.

Also, the rotatable cylinder may comprise a plurality of guide rails disposed on the outer circumference of the rotatable cylinder and extending substantially in parallel to the central axis, the steps each comprises guide rollers in guided engagement with the guide rails for allowing only a translational movement of the step along the guide rails. The upper and lower horizontal runs of the stairway may be disposed at equal circumferential intervals or the first sloped run may have a circumferential distance larger than that of said second sloped run.

The circulating circular escalator may comprise at least one intermediate horizontal run at an intermediate level between the upper and lower horizontal runs, the first sloped run being divided into at least two sections by the intermediate horizontal run, and another landing board extending over each of the at least one intermediate horizontal run of the stairway.

BRIEF DESCRIPTION OF THE DRAWINGS

The present invention will become more readily apparent from the following detailed description of the preferred embodiment of the present invention taken conjunction with the accompanying drawings, in which.

DESCRIPTION OF THE PREFERRED EMBODIMENTS

Figure 1:
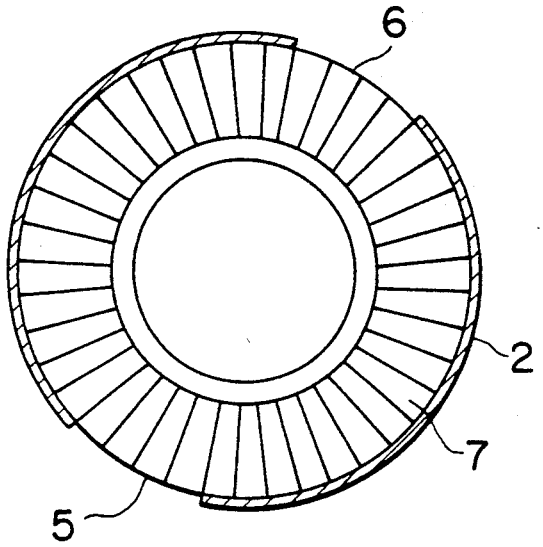
FIG. 1 PRIOR ART
FIGS. 1 and 2 are schematic diagram illustrating the conventional circulating circular escalator.

FIGS. 3 to 7 illustrate one embodiment of a circulating circular escalator of the present invention. As seen from FIG. 3, the circulating circular escalator of the present invention is installed in relation to a building 9 having a lower floor 3 and an upper floor 4. Circular openings 3*a* and 4*a* in the floors 3 and 4, respectively, are surrounded by a tubular wall 9*a* extending between the lower and the upper floors 3 and 4. The tubular wall 9*a* has defined therein two passage openings 9*b* and 9*c*.

The circulating circular escalator comprises a rotatable cylinder 10 installed within circular openings 3*a* and 4*a* formed in the lower and the upper floors 3 and 4 and within the outer cylindrical wall 9*a* with an annular or tubular space formed therebetween. The rotatable cylinder 10 vertically extends at least between the lower floor 3 and the upper floor 4 and rotatable about its substantially vertically-oriented central axis 10*a*. The rotatable cylinder 10 may be supported at a bottom end of the cylinder 10 on the lower floor 3 through a suitable known rotatable support mechanism such as a pivot pin and rollers (not shown). The upper end of the rotatable cylinder 10 may also be rotatably supported by the upper floor 4 through a suitable means.

In order to rotate the rotatable cylinder 10 about its central axis 10*a*, a drive unit 11 is provided. The drive unit 11 may comprise a ring-shaped rack 11*a* circumferentially mounted on the complete inner circumference of the rotatable cylinder 10 and a pinion 11*b* driven by an electric motor 11*c* for example.

The circulating circular escalator also comprises a circular stairway 20 disposed within the annular space defined between the inner rotatable cylinder 10 and the outer cylindrical wall 9*a* around the rotatable cylinder 10. The circular stairway 20 comprises an endless circular loop constituted by a plurality of segment steps 12. As best seen from FIG. 4, the circular stairway 20 comprises a lower horizontal run 20*a* at a level substantially equal to that of the lower floor 3, an upper horizontal run 20*b* at a level substantially equal to that of the upper floor 4, and a first sloped run 20*c* and a second sloped run 20*d* connected between the lower horizontal run 20*a* and the upper horizontal run 20*b*. In the embodiment illustrated in FIGS. 3 and 4, the circular escalator is arranged to rotate in the counterclockwise direction as shown by an arrow A in FIG. 3, and the first sloped run 20*c* is an ascending load-bearing run for upwardly conveying passengers, and the second sloped run 20*d* is a return run on which no passenger is allowed to step on. It is seen that the second sloped run 20*d* which is the return run has a slope angle $\theta$ 2 much larger than a slope angle $\theta$ 1 of the first sloped run 20*c*, so that the first sloped run 20*c* has a circumferential distance much larger than that of the second sloped run 20*d*. This arrangement allows the lift of the circular escalator to be higher than that of the escalator in which the first and the second sloped runs have equal slope angles.

Figure 8:
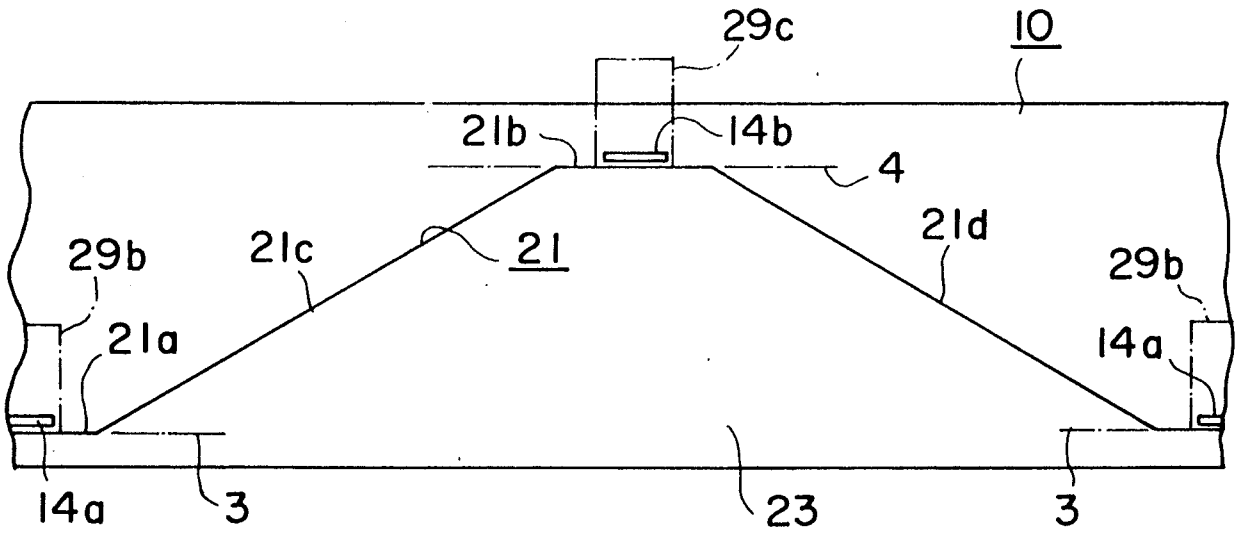
FIG. 8 is a schematic diagram of another embodiment of the circulating circular escalator in which the upper and the lower landing boards are circumferentially spaced apart by 180 degrees.

If desired, the slopes of the first and the second sloped runs may be made equal to each other with the upper and the lower horizontal runs of the stairway positioned at equal circumferential intervals as in the embodiment illustrated in FIG. 8. The circulating circular escalator illustrated in FIG. 8 comprises a cam member 23 disposed around the rotatable cylinder 10 to define a stairway 21. The stairway 21 comprises a lower horizontal run 21*a*, a first sloped run which may be used as an ascending load-bearing run 21*c* for conveying passengers going up, an upper horizontal run 21*b* and a second sloped run 21*d* which may be used as a descending load-bearing run for conveying passengers going down. Passage openings 29*b* and 29*c* in which the landing boards 14*b* and 14*c* are provided are formed at the lower and the upper floors 3 and 4, respectively.

Figure 5:
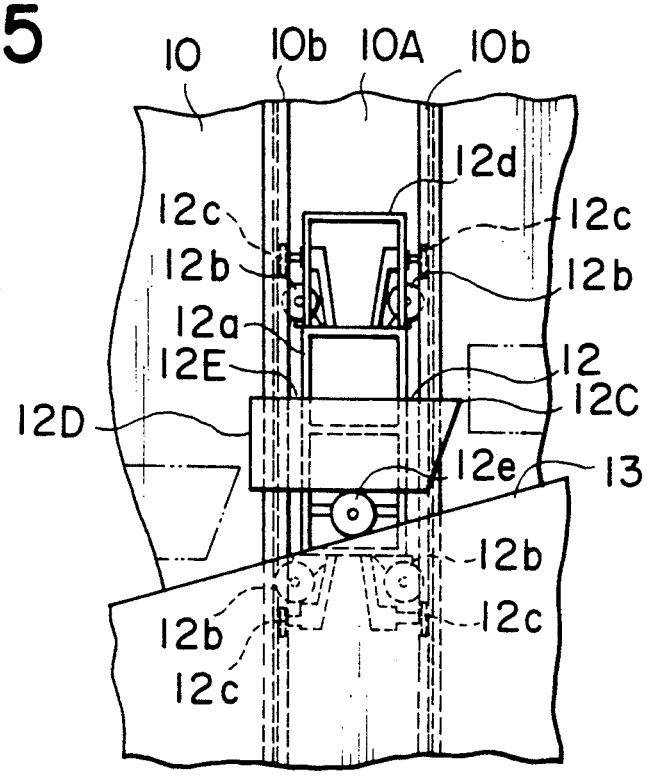
FIG. 5 is a fragmental front view of the step of the circulating circular escalator of the present invention.
Figure 6:
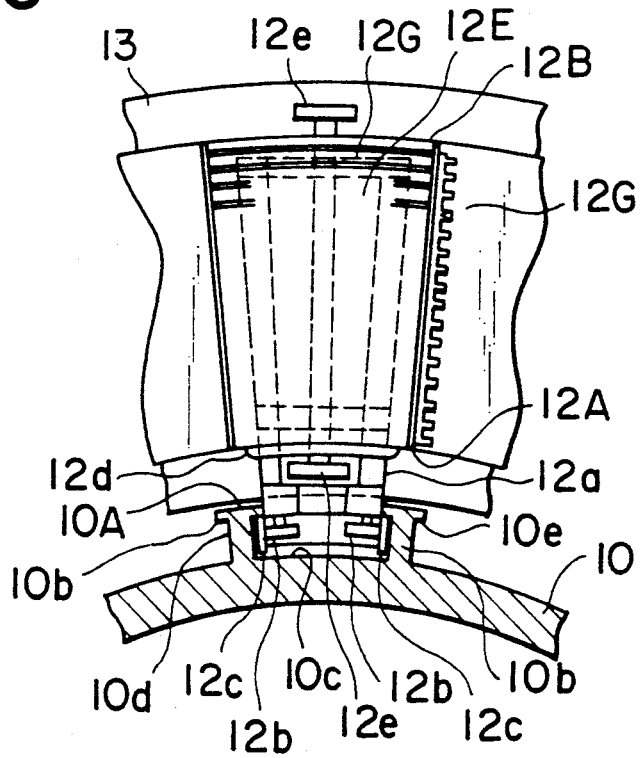
FIG. 6 is a fragmental plan view of the step of the circulating circular escalator.
Figure 7:
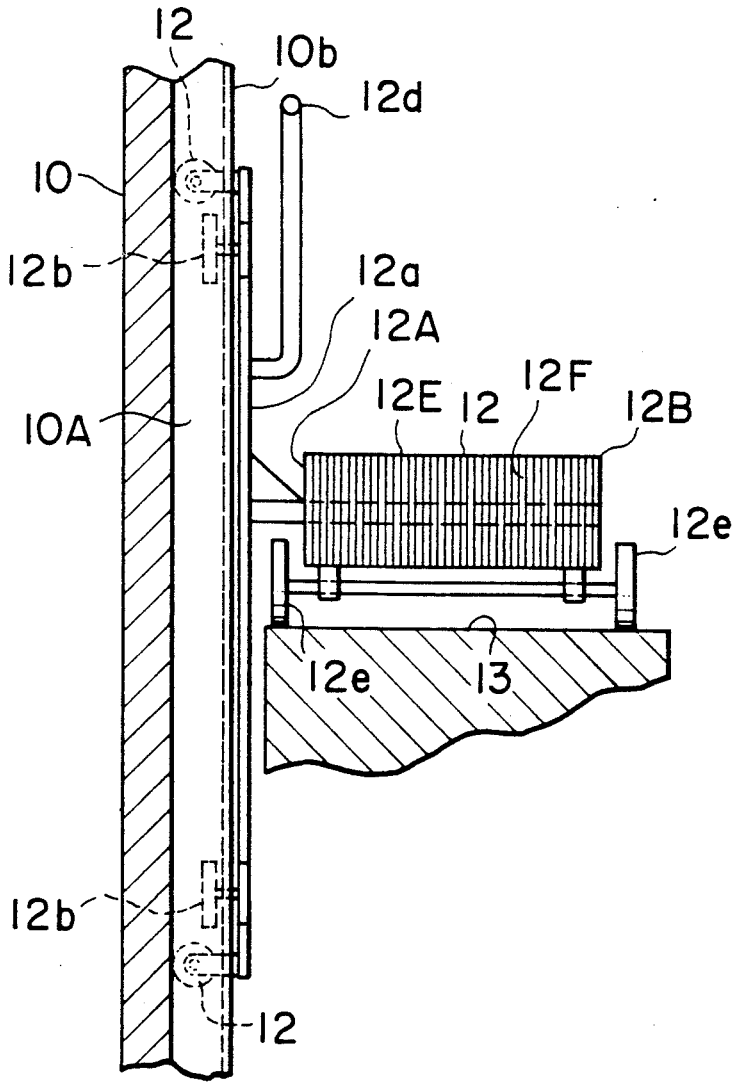
FIG. 7 is a fragmental side view of the step of the circulating circular escalator of the present invention.

As best seen from FIGS. 5 to 7, each of the plurality of steps 12 which is one of the segments constituting the annular stairway 20 has a radially inner side 12A vertically slidably attached to an outer circumference of the rotatable cylinder 10 for rotation therewith, a radially outer side 12B, a leading end 12C, and a trailing end 12D adjacent to the leading end 12C of the adjacent step 12. The steps 12 each has a tread 12E and a riser 12F having formed therein cleats and grooves 12G. Each of the steps 12 is independent of other steps 12 and vertically slidably mounted on the outer circumference of the rotatable cylinder 10 through a mounting bracket 12*a* rigidly attached to the step 12 and guide rail unit 10A secured to the rotatable cylinder 10 so that the step 12 is slidable substantially in parallel with the vertical central axis 10*a* of the rotatable cylinder 10 for a lift corresponding to a distance between the upper and lower floors 3 and 4.

The mounting bracket 12*a* is a substantially rectangular framework rigidly secured to the step 12 and comprises, at each end of the vertically-oriented rectangular framework 12*a*, a pair of circumferential guide rollers 12*b* and a pair of radial guide rollers 12*c* each engaging and rolling along radial and circumferential guide surfaces of the guide rail unit 10A which will be described in more detail later. The mounting bracket 12*a* is also provided with a handle 12*d* which can be grasped for the safety by the passengers (not shown) being conveyed by the steps 12. The step 12 is further provided with a pair of cam-follower rollers 12*e* rotatably mounted to the step 12. It can be seen that in the embodiment of FIG. 6, the guide rollers 12*b* and 12*c* lie between imaginary extensions of the leading end 12C and the trailing end 12D of the step 12.

The circulating circular escalator of the present invention further comprises a circular cam member 13 disposed around the rotatable cylinder 10 for camming and guiding the steps 12 to move along the annular stairway 20. The circular cam member 13 defines a lower horizontal cam surface 13*a* corresponding to the lower horizontal run 20*a* of the stairway 20, an upper horizontal cam surface 13*b* corresponding to the upper horizontal run 20*b*, a first sloped cam surface 13*c* between the lower and the upper horizontal cam surfaces 13*a* and 13*b* and corresponding to the first sloped run 20*c*, and a second sloped cam surface 13*d* connected between the upper and the lower horizontal cam surfaces 13*b* and 13*a* corresponding to the second sloped run 20*d* of the stairway 20. A curved transition portion 13*e* is provided at each of the boundaries between the above runs for smooth movement of the steps 12.

The rotatable cylinder 10 is provided on its outer circumference with the vertical guide rail unit 10A comprising a plurality of guide rails 10b securely disposed at equal circumferential intervals on the outer circumference of the rotatable cylinder 10 to extend substantially in parallel to the central axis 10a of the cylinder 10. Each of the guide rails 10b has a substantially T-shaped cross-section, with its bottom end of the vertical leg or web securely attached to the outer circumferential surface 10c of the rotatable cylinder 10 so that radial guide surfaces 10d in radially extending vertical planes are provided for engaging and guiding the circumferential guide rollers 12b on the mounting bracket 12a along the vertical travel path. The cross bar or flange of the "T" defines circumferential guide surfaces 10e which extend in circumferential vertical planes to engage and guide, together with the circumferential surfaces 10c of the rotatable cylinder 10, the radial guide rollers 12c on the step 12. Thus, the steps 12 each are maintained in a guided engagement with the guide rails 10b through the guide rollers 12b and 12c, whereby the steps 12 are allowed to make only translational movements along the guide rail unit 10A so that the steps 12 are cammed by the cam member 13 to move upwardly along the guide rails 10b on the rotatable cylinder 10 as the rotatable cylinder 10 rotates and the steps 12 are moved along the cam member 13.

Figure 3:
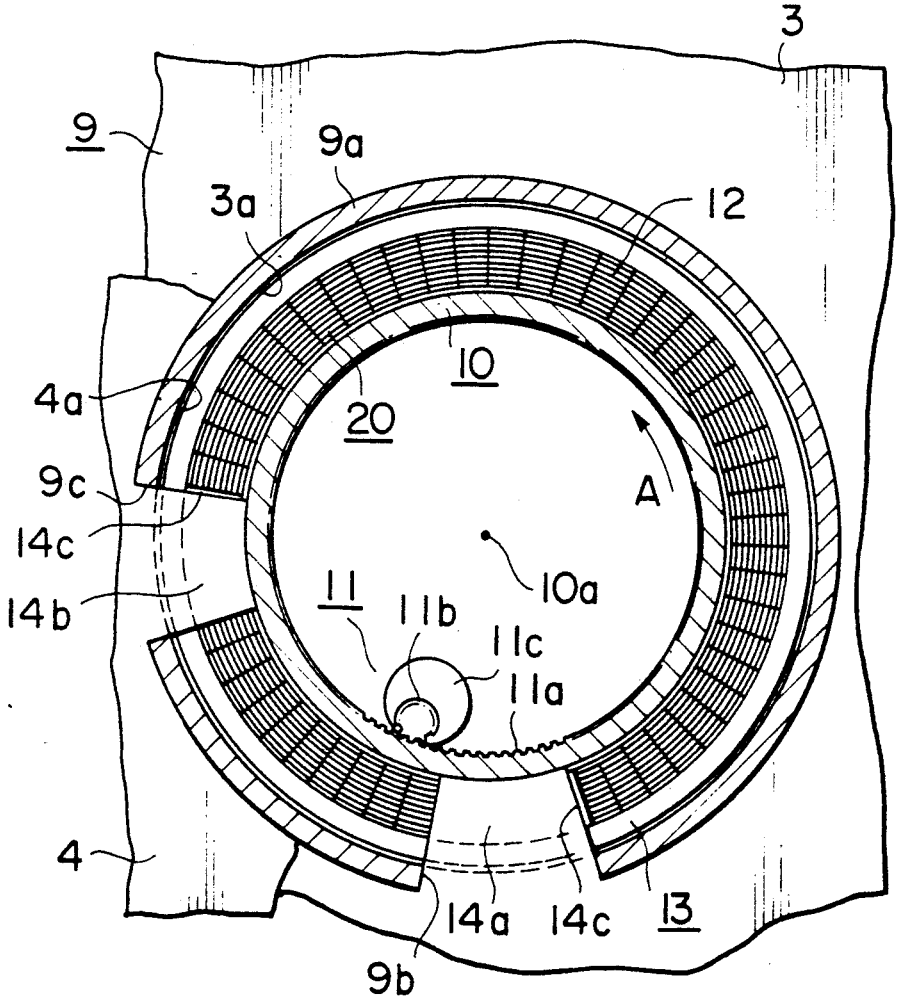
FIG. 3 is a fragmental plan view illustrating the circulating circular escalator of the present invention.
Figure 4:
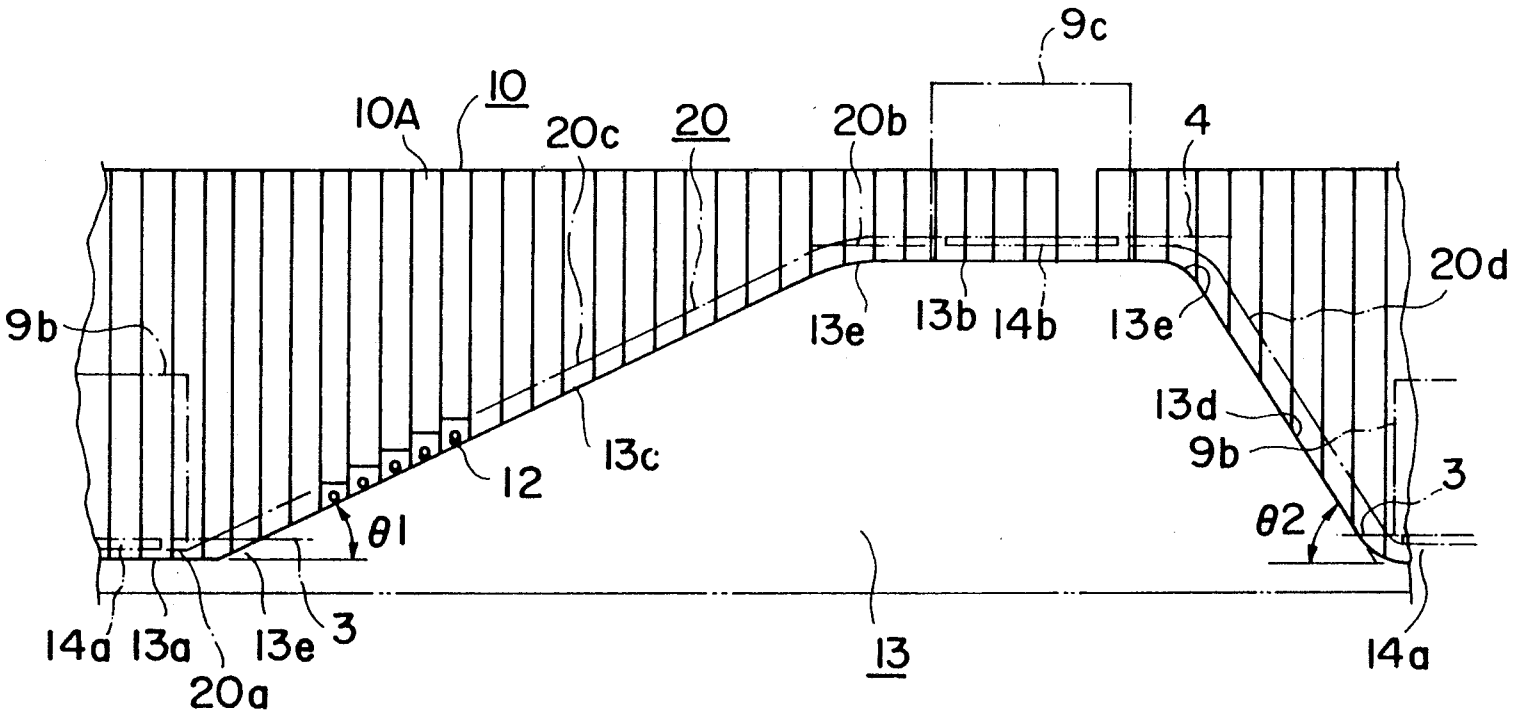
FIG. 4 is a fragmental developed view illustrating the cam arrangement in relation to the steps of the circulating circular escalator of the present invention.

As illustrated in FIGS. 3 and 4, the circulating circular escalator of the present invention comprises a pair of landing boards 14a and 14b extending inwardly from edges of the lower and the upper floors 3 and 4 defining the circular openings 3a and 4a to extend over the lower and the upper horizontal runs 20a and 20b, respectively, of the circular stairway 20 at the circumferential position corresponding to the passage ways 9b and 9c defined in the cylindrical wall 9a. The landing boards 14a and 14b preferably have comb plates 14c which comb the cleats and the grooves 12G on the tread 12E of the steps 12. As shown in FIG. 3, each of the landing boards 14a and 14b has a radially-extending front edge and a radially-extending rear edge, the rear edge being the edge of the landing board under which the leading end of each step first passes as the escalator circulates. It can also be seen from FIG. 3 that the length of passageway 9b in the circumferential direction of the tubular wall 9a is no greater than the circumferential length of landing board 14a, and the length of passageway 9c in the circumferential direction of the tubular wall 9a is no greater than the circumferential length of landing board 14b.

Figure 9:
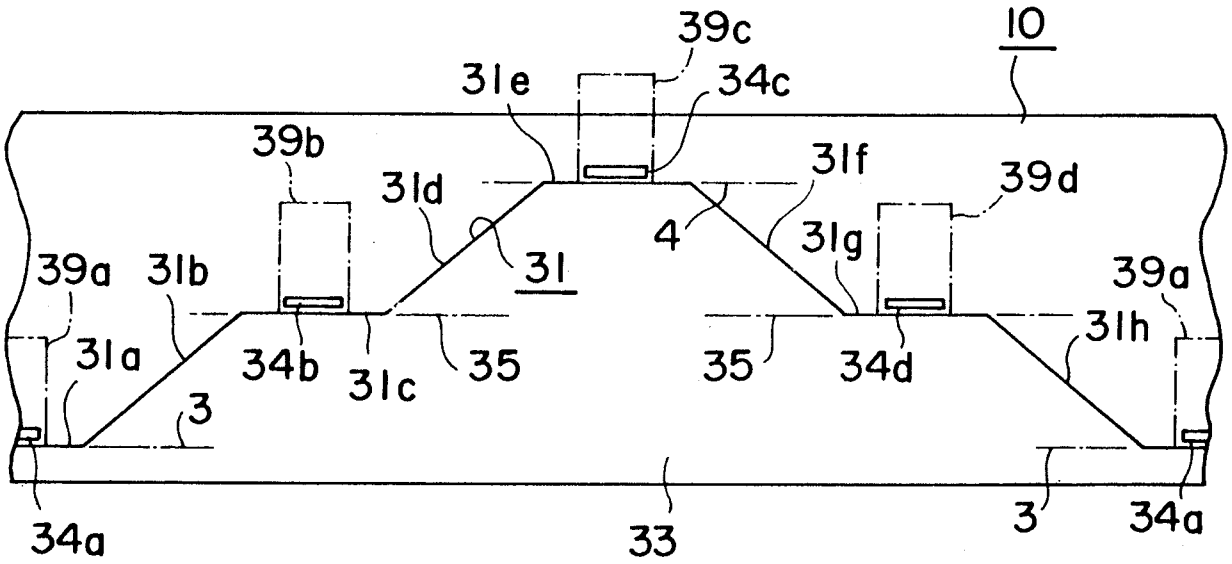
FIG. 9 is a schematic diagram of still another embodiment of the circulating circular escalator in which intermediate landing boards are provided.

As schematically illustrated in FIGS. 9, the circulating circular escalator may comprise a cam member 33 disposed around the rotatable cylinder 10 to define a stairway 31. The stairway 31 comprises a lower horizontal run 31a for serving the lower floor 3 at which a passage way 39a with a landing board 34a is provided. The lower horizontal run 31a continues to a sloped run 31b which may be used as an ascending load-bearing run for conveying passengers going up to an intermediate horizontal run 31c for serving an intermediate floor 35 which is provided with a passage way 39b and a landing board 34b. The intermediate horizontal run 31c is connected through a second sloped run 31d to an upper horizontal run 31e at the level of the upper floor 4 at which an passage way 39c with a landing board 34c is provided. Additionally provided between the upper floor 4 and the lower floor 3 are a sloped run 31f which may be used as a descending load-bearing run for conveying passengers going down, an intermediate horizontal run 31g for serving the intermediate floor 35 provided with a passage way 39d with a landing board 34d and a sloped run 31h. In other words, the first sloped run between the upper and the lower floor or the ascending load-bearing run is divided into two sloped sections 31b and 31d by the intermediate horizontal run 31c, and the second sloped run or the descending load-bearing run is divided into two sloped sections 31f and 31h by the intermediate horizontal run 31g.

During operation of the circulating circular escalator of the present invention as above constructed, as the rotary cylinder 10 is rotated in the counterclockwise direction as indicated by the arrow A in FIG. 3 by the drive unit 11, the steps 12 each attached to the rotary cylinder 10 are also rotated in the counterclockwise direction. During this rotation, the steps 12 which engages at their guide rollers 12e with the cam member 13 are slidingly moved along the guide rail unit 10A on the rotatable cylinder 10 in accordance with the camming action of the cam member 13 to lift the steps 12 between the lower and the upper floor 3 and 4 along the lower horizontal run 20a, the ascending sloped run 20c, the upper horizontal run 20b, the descending sloped run 20d and back to the lower horizontal run 20a again.

The passenger can move in the radial direction onto the lower landing board 14a from the lower floor 3 through the passage way 9b defined in the outer wall 9a, and then the passenger can turn to the right as viewed in FIG. 3 to step onto one of the steps 12 moving on the lower horizontal run 20a. That particular step 12 carrying the passenger soon rides on the sloped cam surface 13c of the cam member 13 to move along the ascending load-bearing run 20c and upwardly moves until it reaches the upper horizontal run 20b where the step 12 travels in the horizontal direction on the upper horizontal cam surface 13b. The passenger can then leave from the step 12 to step onto the upper landing board 14b in the circumferential direction from where he or she can turn to the right as viewed in FIG. 1 and moves out of the escalator onto the upper floor 4 in the radially outward direction through the upper passage opening 9c defined in the outer cylindrical wall 9a.

In the embodiment as above described in conjunction with FIGS. 3 to 7, the slope angle $\theta$ 1 of the ascending load bearing run 20c is 30° and the slope angle $\theta$ 2 of the descending return run 20d is 45° as illustrated in FIG. 4, and the velocity $V_0$ of steps 12 in the upper and lower horizontal runs 20a and 20b is 30 m/min. Also, $V = V_0/\cos\theta$ stands, where $\theta$ is the slope angle of the sloped run, V is velocity of the steps in the sloped run, and $V_0$ is velocity of the steps in the horizontal run. In the embodiment illustrated in FIGS. 3 and 4, the step speed $V_0$ in the horizontal runs 20a and 20b in which the passengers ride on and off is 30 m/min, which is a safe speed for passengers, and the step speed V1 in the ascending load bearing run is 34.6 m/min, which is a safe but sufficiently efficient speed for conveying passengers, and the step speed V2 in the steep return run is 42.3 m/min, which is a highly efficient speed.

In the embodiment illustrated in FIG. 8 where the upper and the lower horizontal runs 21a and 21b of the annular stairway 21 are positioned at a diametrically opposite positions, when cam member 23 is designed to have an outer diameter of 20m, a slope angle of 30° and a circumferential length of each of the upper and the lower horizontal runs 21c and 21d of about 7m, a lift of an escalator of about 14m can be obtained, providing an escalator which is relatively compact but still has a high lift.

In the embodiment illustrated in FIGS. 3 to 7, a higher lift of about 20*m* can be obtained when the slope angle $\theta$ 1 in the ascending load bearing run is selected to be 30° and the slope angle $\theta$ 2 of the return run is selected to be 55° with the other conditions same as those just above described in conjunction with the embodiment of FIG. 8.

As has been described, the circulating circular escalator of the present invention comprises a vertically-oriented rotatable cylinder extending between upper and lower floors, an annular stairway disposed about the rotatable cylinder and having a plurality of steps, an annular cam member disposed around the rotatable cylinder for camming and guiding the steps to move along the stairway, and a landing board extending over each of the upper and lower horizontal runs of the stairway. The stairway includes a lower horizontal run at a lower floor level, an upper horizontal run at an upper floor level, and ascending and descending sloped runs connected between the lower and upper runs. The sloped runs may be used for conveying passengers or either one of the runs may be used as a return run. The inner side of the steps are attached to the rotatable cylinder for rotation therewith, the steps each being independently vertically slidable relative to the rotatable cylinder for a lift between the upper and lower floors. The steps are supported and guided by vertical guide rails on the rotatable cylinder and guide rollers on the steps for smooth translational movement. The load-bearing run may be made longer and therefore less steeper than the return run. Also, at least one intermediate horizontal run with a landing board may be disposed at an intermediate level between the upper and lower horizontal runs for serving an additional intermediate floor. A stationary cylindrical outer wall surrounding the stairway for defining a substantially closed annular space within which the annular stairway may be disposed between the rotatable cylinder and the stationary cylindrical outer wall, and the outer wall has a passage opening formed therein for allowing passengers to have access therethrough to the landing board.

Figure 2:
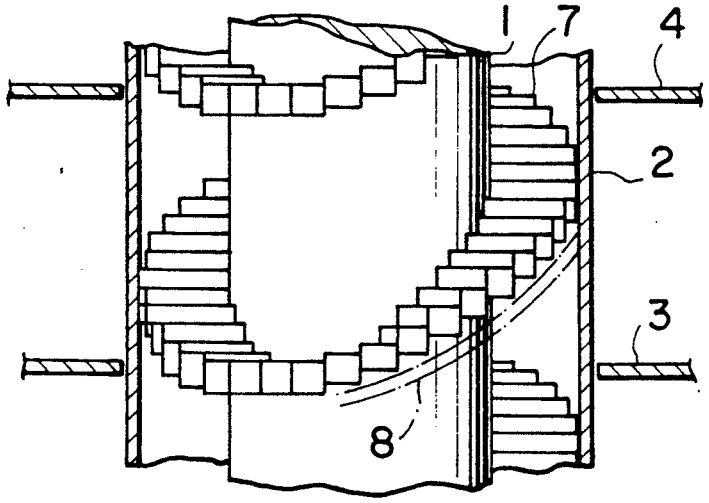
FIG. 2 PRIOR ART

Therefore, the access to the escalator can be made through a stationary passageway providing a significant advantage over the conventional escalator illustrated in FIGS. 1 and 2.

Since the landing boards are provided the passengers can step onto or from the moving steps in the same direction as the movement of the steps, which also greatly increase the safety of the escalator.

Also, since the steps travels along the slopes, passengers are allowed to walk on the staircase and arrive at the exit landing board, significantly increasing the capacity of the escalator. This is not the case in the conventional circulating escalator shown in FIGS. 1 and 2.

Accordingly, a circulating circular escalator free from the disadvantages of the above-discussed conventional circulating circular escalator can be eliminated, and the circulating circular escalator of the invention is safe for the passengers and has a large capacity.

If desired, the landing boards may be arranged in a draw-bridge fashion so that the landing board may be swung upward.

What is claimed is:

1. A circulating circular escalator comprising:

a rotatable cylinder extending at least between an upper floor and a lower floor and rotatable about a substantially vertical axis;

drive means for rotating said rotatable cylinder about said axis;

a circular stairway disposed about said rotatable cylinder and having a lower horizontal run at a level of said lower floor, an upper horizontal run at a level of said upper floor, and a first and a second sloped run connected between said lower and upper horizontal runs, said stairway including a plurality of steps each having an inner side attached to an outer circumference of said rotatable cylinder for rotation therewith and a leading edge extending radially with respect to said axis, said steps each being independently slidable along said axis of said rotatable cylinder for a lift corresponding to the distance between said upper and lower floors;

circular cam means disposed around said rotatable cylinder for camming and guiding said steps to move along said stairway; and upper and lower landing boards extending over said upper and lower horizontal runs, respectively, each of said landing boards having a rear edge extending radially with respect to said axis.

2. A circulating circular escalator as claimed in claim 1 wherein said cam means comprises a lower horizontal cam surface corresponding to said lower horizontal run, an upper horizontal cam surface corresponding to said upper horizontal run, and a first and a second sloped cam surface connected between said upper and lower horizontal cam surfaces.

3. A circulating circular escalator as claimed in claim 1 further comprising a stationary cylindrical outer wall surrounding said stairway for defining a substantially closed annular space within which said annular stairway is disposed, said outer wall having openings for allowing passengers to access said landing boards.

4. A circulating circular escalator as claimed in claim 1 wherein said first and said second sloped runs comprise an an ascending and a descending load-bearing run for conveying passengers.

5. A circulating circular escalator as claimed in claim 1 wherein said first sloped run comprises a load-bearing run for conveying passengers and said second sloped run comprises a return run having a slope steeper than that of said first sloped run.

6. A circulating circular escalator as claimed in claim 1 wherein said rotatable cylinder comprises a plurality of guide rails disposed on said outer circumference of said rotatable cylinder and extending substantially parallel to said axis, and each step comprises guide rollers in guided engagement with said guide rails for allowing only translational movement of said step along said guide rails.

7. A circulating circular escalator as claimed in claim 1 wherein each step is a segment of said annular stairway.

8. A circulating circular escalator as claimed in claim 1 wherein each step has a tread and a riser having cleats and grooves formed therein.

9. A circulating circular escalator as claimed in claim 1 wherein each step has a roller in engagement with and guided by said cam surfaces of said cam means.

10. A circulating circular escalator as claimed in claim 1 wherein said upper and lower horizontal runs of said stairway are disposed at equal circumferential intervals.

11. A circulating circular escalator as claimed in claim 5 wherein said first sloped run has a circumferential length larger than that of said second sloped run.

12. A circulating circular escalator as claimed in claim 1 wherein each step has a handle for a passenger mounted thereon.

13. A circulating circular escalator as claimed in claim 1 further comprising an intermediate horizontal run at an intermediate level between said upper and lower horizontal runs, and a landing board extending over said intermediate horizontal run.

14. A circulating circular escalator comprising:

a rotatable cylinder having an outer circumference and extending at least between an upper floor and a lower floor and rotatable about a substantially vertical axis and including a plurality of guide rails disposed on said outer circumference and extending substantially parallel to said axis, each of said guide rails having a generally T-shaped cross-section and comprising a web extending radially from said rotatable cylinder and a flange extending from said web in the circumferential direction of said rotatable cylinder;

drive means for rotating said rotatable cylinder about said axis;

a circular stairway disposed about said rotatable cylinder and having a lower horizontal run at a level of said lower floor, an upper horizontal run at a level of said upper floor, and a first and a second sloped run connected between said lower and upper horizontal runs, said stairway including a plurality of steps each having an inner side attached to an outer circumference of said rotatable cylinder for rotation therewith, said steps each being independently slidable along said axis of said rotatable cylinder for a lift corresponding to the distance between said upper and lower floors, each of said steps having a pair of first guide rollers disposed between adjacent guide rails and contacting the webs of the adjacent guide rails and a pair of second guide rollers disposed between adjacent guide rails and contacting the flanges of the adjacent guide rails;

circular cam means disposed around said rotatable cylinder for camming and guiding said steps to move along said stairway; and upper and lower landing boards extending over said upper and lower horizontal runs, respectively.

15. A circulating circular escalator as claimed in claim 14 wherein each of said webs of said guide rails has a first lateral surface and a second lateral surface, said first lateral surface contacting a first guide roller of one of said steps while said second lateral surface contacts a first guide roller of an adjacent one of said steps.

16. A circulating circular escalator as claimed in claim 14 wherein each step has a top surface with a leading end and a a plurality of steps disposed about the rotating member to form a continuous stairway, each of the steps having a radially inner portion connected to the rotating member for movement parallel to the axis and for rotating with the rotating member;

guide means for guiding the steps along path having a lower horizontal portion at the lower floor, an upper horizontal portion at the upper floor, and a sloping portion connecting the lower horizontal portion and the upper horizontal portion;

stationary upper and lower support surfaces for passengers extending from the upper and lower floors, respectively, the steps passing beneath the support surfaces when traveling along the horizontal portions of the path; and movement restricting means for restricting the movement of a passenger on the escalator off any of the steps in a radial direction with respect to the axis, the movement restricting means comprising a wall substantially surrounding the steps and having a lower opening for passengers adjoining the lower support surface and an upper opening for passengers adjoining the upper support surface, the circumferential length of the upper and lower openings being no greater than the circumferential length of the upper and lower support surfaces, respectively.

17. A circulating circular escalator comprising:

a stationary cylinder having an axis and extending from a lower floor through an upper floor and having a lower opening and an upper opening formed therein at the upper and lower floors;

a rotating member coaxially disposed within the cylinder;

drive means for rotating the rotating member about the axis;

a plurality of steps disposed between the cylinder and the rotating member to form a continuous stairway, each of the steps having a radially inner portion connected to the rotating member for movement parallel to the axis and for rotation with the rotating member;

guide means for guiding the steps along a path having a lower horizontal portion adjoining the lower opening, an upper horizontal portion adjoining the upper opening, and a sloping portion connecting the lower horizontal portion and the upper horizontal portion; and stationary upper and lower support surfaces for passengers extending from the upper and lower floors into the cylinder at the upper and lower openings, respectively, the steps passing beneath the support surfaces when traveling along the horizontal portions of the path, the circumferential length of the upper and lower openings being no greater than the circumferential length of the upper and lower support surfaces, respectively.

18. A circulating circular escalator as claimed in claim 17 wherein the guide means comprises a spiral ramp disposed between the cylinder and the rotating member.

19. A circulating circular escalator as claimed in claim 17 wherein the upper and lower support surfaces comprise landing boards.

20. A circulating circular escalator comprising:

a rotating member having an axis and extending between a lower floor and an upper floor;

drive means for rotating the rotating member about an axis;

a plurality of steps disposed about the rotating member to form a continuous stairway, each of the steps having a radially inner portion connected to the rotating member for movement parallel to the axis and for rotating with the rotating member;

guide means for guiding the steps along path having a lower horizontal portion at the lower floor, an upper horizontal portion at the upper floor, and a sloping portion connecting the lower horizontal portion and the upper horizontal portion;

stationary upper and lower support surfaces for passengers extending from the upper and lower floors, respectively, the steps passing beneath the support surfaces when traveling along the horizontal portions of the path; and movement restricting means for restricting the movement of a passenger on the escalator off any of the steps in a radial direction with respect to the axis, the movement restricting means comprising a wall substantially surrounding the steps and having a lower opening for passengers adjoining the lower support surface and an upper opening for passengers adjoining the upper support surface, the circumferential length of the upper and lower openings being no greater than the circumferential length of the upper and lower support surfaces, respectively.

* * * * *

UNITED STATES PATENT AND TRADEMARK OFFICE

CERTIFICATE OF CORRECTION

PATENT NO. : 5,165,513

DATED : November 24, 1992

INVENTOR(S) : Hiroshi Nakatani

It is certified that error appears in the above-identified patent and that said Letters Patent is hereby corrected as shown below:

TITLE PAGE:
Item no. 56, References Cited, Foreign Patent Documents, change "8910890 11/1989 Japan" to --8910890 11/1989 Germany--.

Claim 16, col. 9 and 10, change the entire claim to read:

A circulating circular escalator as claimed in claim 14 wherein each step has a top surface with a leading end and a trailing end, and each of said guide rollers is disposed between an extension of said leading end and an extension of said trailing end of said step.

Signed and Sealed this

Fourteenth Day of December, 1993

Bruce Lehman

*Attest:*

BRUCE LEHMAN

*Attesting Officer*

*Commissioner of Patents and Trademarks*